US007518089B2

(12) United States Patent
Hashiguchi et al.

(10) Patent No.: US 7,518,089 B2
(45) Date of Patent: Apr. 14, 2009

(54) IMAGE HEATING APPARATUS INCLUDING FLEXIBLE METALLIC SLEEVE, AND HEATER USED FOR THIS APPARATUS

(75) Inventors: Shinji Hashiguchi, Mishima (JP); Koji Nihonyanagi, Susono (JP); Eiji Uekawa, Mishima (JP); Hiroto Hasegawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/222,945

(22) Filed: Sep. 12, 2005

(65) Prior Publication Data

US 2006/0056891 A1 Mar. 16, 2006

(30) Foreign Application Priority Data

Sep. 16, 2004 (JP) ..... 2004-269959

(51) Int. Cl.

| | |
|---|---|
| ***G03G 15/20*** | (2006.01) |
| ***H05B 3/10*** | (2006.01) |
| ***H05B 3/22*** | (2006.01) |
| ***H05B 3/28*** | (2006.01) |

(52) U.S. Cl. ..... 219/216; 219/546; 219/548; 399/328; 399/329

(58) Field of Classification Search ..... None
See application file for complete search history.

(56) References Cited

U.S. PATENT DOCUMENTS

| | | | | |
|---|---|---|---|---|
| 5,153,654 | A | 10/1992 | Yuminamochi et al. | 355/277 |
| 5,401,936 | A | 3/1995 | Kusaka et al. | 219/216 |
| 5,682,576 | A | 10/1997 | Sakai et al. | 399/69 |
| 5,742,878 | A | 4/1998 | Kuroda | 399/122 |
| 5,991,555 | A | 11/1999 | Suzumi et al. | 399/18 |
| 6,005,594 | A | 12/1999 | Nanataki et al. | 347/156 |
| 6,075,228 | A | 6/2000 | Goto et al. | 219/216 |
| 6,085,058 | A | 7/2000 | Goto et al. | 399/313 |
| 6,246,035 | B1 * | 6/2001 | Okuda | 219/619 |
| 6,347,211 | B2 | 2/2002 | Nanataki et al. | 399/328 |
| 6,397,034 | B1 * | 5/2002 | Tarnawskyj et al. | 399/308 |
| 6,493,521 | B2 | 12/2002 | Miyamoto et al. | 399/44 |
| 6,671,488 | B2 | 12/2003 | Izawa et al. | 399/329 |
| 6,701,102 | B2 | 3/2004 | Hasegawa et al. | 399/69 |
| 6,713,725 | B2 | 3/2004 | Izawa et al. | 219/216 |
| 6,748,192 | B2 * | 6/2004 | Izawa et al. | 399/329 |
| 6,763,205 | B2 | 7/2004 | Izawa et al. | 399/69 |
| 6,787,737 | B2 | 9/2004 | Uekawa et al. | 219/216 |
| 6,794,611 | B2 | 9/2004 | Kataoka et al. | 219/216 |
| 6,862,416 | B2 | 3/2005 | Hashiguchi et al. | 399/69 |
| 6,895,207 | B2 | 5/2005 | Kataoka et al. | 399/328 |
| 6,915,099 | B2 | 7/2005 | Izawa et al. | 399/328 |

(Continued)

FOREIGN PATENT DOCUMENTS

| | | | |
|---|---|---|---|
| JP | 60-073631 A | * | 4/1985 |

(Continued)

*Primary Examiner*—Joseph M Pelham
(74) *Attorney, Agent, or Firm*—Fitzpatrick, Cella, Harper & Scinto

(57) ABSTRACT

The present invention relates to an image thermal apparatus including a flexible metallic sleeve, the inner peripheral surface of which contacts a heater. In order to provide increased durability for the sliding face of the heater, an imide resin that contains silicon nitride elementary particles is used to coat the sliding face of the heater.

14 Claims, 5 Drawing Sheets

U.S. PATENT DOCUMENTS

| | | | | |
|---|---|---|---|---|
| 6,920,293 | B2 | 7/2005 | Izawa et al. | 399/67 |
| 6,944,420 | B2 | 9/2005 | Kanamori et al. | 399/329 |
| 6,952,538 | B2 | 10/2005 | Hashiguchi et al. | 399/45 |
| 6,965,742 | B2 | 11/2005 | Miyamoto et al. | 399/50 |
| 2003/0035667 | A1 * | 2/2003 | Izawa et al. | 399/333 |
| 2003/0042241 | A1 | 3/2003 | Uekawa et al. | 219/216 |
| 2005/0163523 | A1 | 7/2005 | Omata et al. | 399/69 |
| 2005/0169656 | A1 | 8/2005 | Nihonyanagi et al. | 399/69 |
| 2005/0191070 | A1 | 9/2005 | Izawa et al. | 399/44 |
| 2005/0191075 | A1 | 9/2005 | Kimizuka et al. | 399/69 |
| 2005/0201788 | A1 | 9/2005 | Kubochi et al. | 399/381 |
| 2005/0207770 | A1 | 9/2005 | Nihonyanagi et al. | 399/67 |
| 2005/0244200 | A1 | 11/2005 | Kanamori et al. | 399/333 |
| 2006/0008286 | A1 | 1/2006 | Nihonyanagi et al. | 399/69 |
| 2006/0056891 | A1 | 3/2006 | Hashiguchi et al. | 399/329 |

FOREIGN PATENT DOCUMENTS

| | | | |
|---|---|---|---|
| JP | 63-313182 | | 12/1988 |
| JP | 01-115983 | A * | 5/1989 |
| JP | 01-141794 | A * | 6/1989 |
| JP | 02-085519 | A * | 3/1990 |
| JP | 2-157878 | | 6/1990 |
| JP | 3-263073 | | 11/1991 |
| JP | 4-44075 | | 2/1992 |
| JP | 4-44076 | | 2/1992 |
| JP | 4-44077 | | 2/1992 |
| JP | 4-44078 | | 2/1992 |
| JP | 4-44079 | | 2/1992 |
| JP | 4-44080 | | 2/1992 |
| JP | 4-44081 | | 2/1992 |
| JP | 4-44082 | | 2/1992 |
| JP | 4-44083 | | 2/1992 |
| JP | 4-204980 | | 7/1992 |
| JP | 4-204981 | | 7/1992 |
| JP | 4-204982 | | 7/1992 |
| JP | 4-204983 | | 7/1992 |
| JP | 4-204984 | | 7/1992 |
| JP | 6-3982 | | 1/1994 |
| JP | 7-199699 | | 8/1995 |
| JP | 10-319753 | | 12/1998 |
| JP | 11-174875 | | 7/1999 |
| JP | 2000-29334 | | 1/2000 |
| JP | 2003-57978 | | 2/2003 |
| JP | 2003-131502 | | 5/2003 |
| JP | 2004-149622 | A * | 5/2004 |

* cited by examiner

METALLIC SLEEVE SLIDING FACE

METALLIC SLEEVE SLIDING FACE

METALLIC SLEEVE SLIDING FACE

SLIDE LAYER SURFACE

SLIDE LAYER SURFACE

IMAGE HEATING APPARATUS INCLUDING FLEXIBLE METALLIC SLEEVE, AND HEATER USED FOR THIS APPARATUS

BACKGROUND OF THE INVENTION

1. Field of the Invention

The present invention relates to an image heating apparatus appropriate for use as a thermal fixing apparatus, mounted, for example, in a copier or a printer, and a heater employed for this apparatus. In particular, the present invention relates to an image heating apparatus having a flexible metallic sleeve and a heater employed for this apparatus.

2. Description of the Related Art

Most conventional copiers and printers of an electrophotographic type adopt, as fixing means, a thermal roller fixing system, of a contact heating type, that provides satisfactory heating efficiency and safety, or a system whereby power is not supplied to a thermal fixing apparatus in the standby state and power consumption is as greatly reduced as possible; specifically, a film heating system of an energy saving type is one wherein a thin film is arranged between a heater and a pressure roller, and the thermal fixing of a toner image to a recording medium is performed through the film. An example thermal heating method that uses the film heating system is proposed, for example, in Japanese Patent Laid-Open No. Sho 63-313182, No. Hei 2-157878, No. Hei 4-44075 and No. Hei 4-204980. The schematic configuration of such an example film heating system is shown in FIG. 9. As shown in FIG. 9, a fixing apparatus of a film heating type includes: a heating member (a heating body; hereinafter referred to as a heater) securely supported by a stay holder (a support body); a heat resistant thin film (hereinafter referred to as a fixing film) 3, the inner peripheral surface of which contacts the heater 2; and a elastic pressure roller 4 that, with the heater 2, grips the film 3 to form a nip portion (a fixing nip portion) having a predetermined nip width. The heater 2 is controlled so as to maintain a predetermined temperature while power is received. The fixing film 3 is a cylindrical member, an endless belt shaped member, or a finite web roll member, and by using a rotation force supplied by drive transmission means (not shown) or the pressure roller 4, the fixing film 3 closely contacts and slides across the heater 2 at the fixing nip portion, and is conveyed in the direction indicated by an arrow.

In a condition under which the heat output by the heater has been adjusted to provide the predetermined temperature and the fixing film 3 has been moved in the direction indicated by the arrow, the medium to be heated, a recording medium bearing an unfixed toner image, is fed between the fixing film 3 and the pressure roller 4 at the fixing nip portion. The recording medium, held closely in contact with the face of the fixing film 3, and the fixing film 3 are then conveyed through the fixing nip portion. At the fixing nip portion, the toner image is heated by the heater 2, through the fixing film 3, and is thermally fixed to the recording medium. The recording medium, having passed through the fixing nip portion and having, thereafter, been separated from the face of the fixing film 3, is conveyed away from the fixing nip portion.

The stay holder 1, a heat resistant plastic member, for example, is used to hold the heater 2 and to guide the fixing film 3. In order to minimize the friction when the fixing film slides across the stay holder 1 and the heater 2, grease having a high heat resistance is used to coat the outer faces of the heater 2 and the stay holder 1. The pressure roller 4 is made by forming, around a core 6, a silicon rubber layer or a sponge layer 7 made of foamed silicon rubber, and then by forming, on the layer 7, a tubular shaped releasing layer 8 made of PTFE, PFA or FEP, or by applying a releasing layer 8 as a coating.

The fixing film 3 is quite thin, i.e., 20 to 70 μm, so that the heater 2 can efficiently apply heat at the fixing nip portion to the recording medium that is to be heated. The fixing film 3 includes three layers: a film base layer, a conductive primer layer and a releasing layer, with the film base layer on the heater side and the releasing layer on the pressure roller side. The film base layer is a heat resistant, very flexible layer that is made of a heat resistant resin, such as insulating polyimide, polyamideimide or PEEK, or a metal such as SUS, and has a thickness of about 15 to 60 μm. Further, because of the presence of the film base layer, the mechanical strength, such as the tear strength, of the entire fixing film 3 is maintained. The conductive primer layer is a thin layer, about 2 to 6 μm thick, and is electrically grounded in order to prevent the entire fixing film 3 from becoming charged. The releasing layer is a layer for preventing toner offset relative to the entire fixing film 3, and is made by applying a coating of a fluorine resin, such as PFA, PTFE or FEP, having a satisfactory release property of about 5 to 15 μm. Furthermore, in order to reduce the charge on the surface of the fixing film 3 and to prevent electrostatic offset, a conductive material, for example, is made by mixing carbon black having a specific resistance of about $10^3$ Ωcm to $10^6$ Ωcm in the releasing layer.

A ceramic heating member is generally employed as the heater 2. For example, using screen printing, a heat generating resistance layer, such as silver palladium (Ag/Pd).Ta2N, is formed in the longitudinal direction (the direction perpendicular to the plane of paper) on the surface (the surface that does not face the fixing film 3) of an electrically insulating, aluminum nitride ceramic substrate having a superior thermal conductive property and a small thermal capacity, and in addition, a heat generating resistance layer formation face is covered with a thin glass protective layer. Further, a slide layer is formed on the face of the ceramic substrate that contacts the fixing film 3 to reduce the damage friction may cause to the fixing film 3. The slide layer that contacts the fixing film 3 is generally made of glass when the base layer of the fixing film 3 is formed of a resin, such as polyimide. When the base layer of the fixing film 3 is made of a metal such as SUS, however, the durability of the glass layer is reduced. Therefore, to provide for such an event, a method whereby the slide layer on the slide face of the heater 2 is formed of a resin, such as polyimide or polyamideimide, is disclosed in Japanese Patent Laid-Open Publication No. 2003-57978.

According to the ceramic heater 2, when power is supplied to the heat generating resistance layer, the heat generating resistance layer generates heat, and the temperature of the entire heater, including the ceramic substrate and the slide layer, is rapidly raised. The rise in the temperature of the heater 2 is detected by temperature detection means 5, located at the rear of the heater 2, and is fed back to a power controller (not shown). The power controller controls the power supplied to the heat generating resistance layer, so that at the heater 2 a substantially predetermined temperature (a fixing temperature) is constantly detected by the temperature detection means 5. This control process enables the heater 2 to maintain a predetermined fixing temperature.

To increase the processing capability of an image forming apparatus, the heating efficiency of a fixing apparatus must also be increased. And in order to efficiently transmit heat generated by the heater to a recording medium, the conduction of heat by the base layer of the fixing film must be improved. For a resin fixing film, heat conduction can be improved by mixing heat conductive filler into the resin.

However, when too large an amount of heat conductive filler is mixed into the resin, the tear strength of the fixing film is reduced and tearing of the film will occur. Thus, in order to eliminate the heat conduction and tear strength problems, a proposed fixing film is one for which the base layer is made of metal. When a metal fixing film is employed, as disclosed in Japanese Patent Laid-Open Publication No. 2003-57978, it is preferable that the slide layer of the heater be made of a resin such as polyimide.

It has been found, however, that when coping with an increase in the processing speed of an image forming apparatus, merely making the slide layer of the heater of a resin such as polyimide is not sufficient. Means for increasing the processing capability of the fixing apparatus can include the application of an increased pressurizing force at the fixing nip or the raising the temperature of the heater during the fixing process. However, increasing the pressuring force and raising the temperature of the heater both tend to accelerate the abrasion of the slide layer of the heater. As the slide layer of the heater is worn down by abrasion, particles removed from the slide layer mix with the grease between the surface of the heater and the metallic sleeve. As a result, the desired viscosity and smoothness of the grease is lost, the resistance produced by friction is increased, and the drive torque becomes greater. When the drive torque is increased, it is difficult to rotate the fixing film at high speed, and the processing capability of the fixing apparatus can not be improved. And when a thick slide layer is formed, although the durability of the slide layer is increased, the heat generated by the heater is not easily transmitted to the nip portion. Thus, the method employed to increase the thickness of the slide layer is also not acceptable.

SUMMARY OF THE INVENTION

To resolve these shortcomings, one objective of the present invention is to provide a heater having a durable slide layer, and an image heating apparatus that employs this heater.

Another objective of the present invention is to provide an image heating apparatus comprising:

a flexible metallic sleeve; and a heater, which contacts an inner peripheral surface of the flexible metallic sleeve, wherein a resin layer is formed on a surface of the heater that contacts the inner peripheral surface of the flexible metallic sleeve, wherein the resin layer has a thickness equal to or greater than 2 μm and equal to or smaller than 10 μm, and contains an abrasion resistant material, and wherein particles of the abrasion resistant material have a mean size equal to or greater than 0.1 μm and equal to or smaller than 2.0 μm, and the abrasion resistant material content is greater than 0% and less than 10%.

An additional objective of the present invention is to provide a heater comprising:

a substrate;

a heat generating resistor formed on the substrate; and a resin layer that contacts a flexible metallic sleeve, wherein the resin layer has a thickness equal to or greater than 2 μm and equal to or smaller than 10 μm, and contains an abrasion resistant material, and wherein particles of the abrasion resistant material have a mean size equal to or greater than 0.1 μm and equal to or smaller than 2.0 μm, and the abrasion resistant material content is greater than 0% and less than 10%.

A further objective of the present invention is to provide an image heating apparatus comprising:

a flexible metallic sleeve; and a heater that contacts an inner peripheral surface of the flexible metallic sleeve, wherein a resin layer is formed on a surface of the heater that contacts the inner peripheral surface of the flexible metallic sleeve, and wherein a material for the resin layer is an imide resin containing silicon nitride.

One more objective of the present invention is to provide a heater comprising:

a substrate;

a heat generating resistor formed on the substrate; and a resin layer that contacts a flexible metallic sleeve, wherein a material for the resin layer is an imide resin containing silicon nitride.

Further features of the present invention will become apparent from the following description of exemplary embodiments (with reference to the attached drawings).

DESCRIPTION OF THE EMBODIMENTS

First Embodiment (1) Explanation of an Image Forming Apparatus

Figure 1:
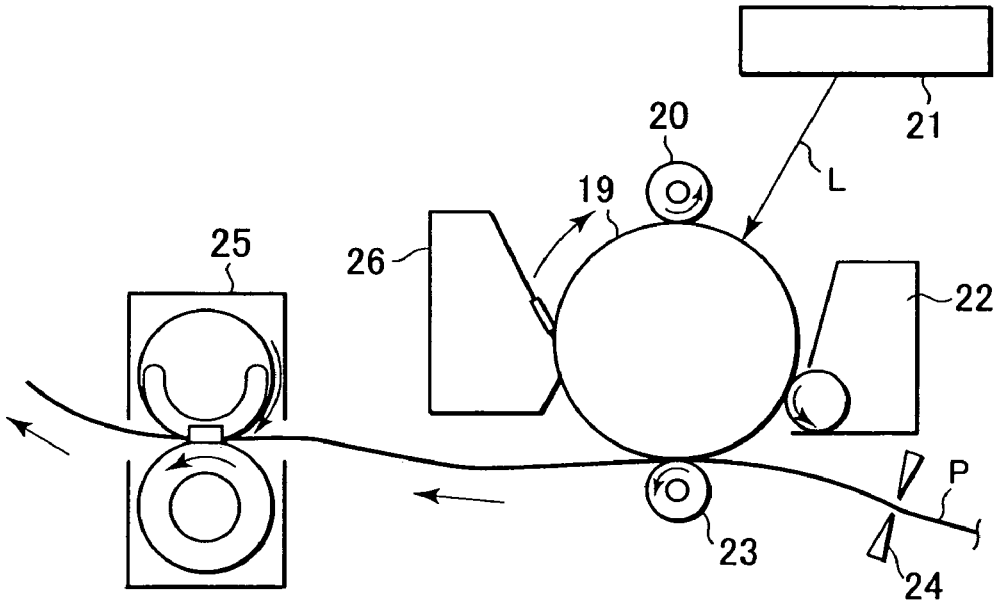
FIG. 1 is a schematic diagram showing the configuration of an image forming apparatus mounting an image heating apparatus according to the present invention.

FIG. 1 is a schematic diagram showing the configuration of an image forming apparatus in which is mounted an image heating apparatus according to a first embodiment of the invention. The image forming apparatus in this embodiment is a laser printer employing an electrophotographic process.

A photosensitive drum 19 is made by depositing a photosensitive material, such as amorphous Se or amorphous Si, on an aluminum or nickel cylinder substrate.

First, the photosensitive drum 19 is rotated in the direction indicated by an arrow, and the surface of the photosensitive drum 19 is uniformly electrified by a charging device, a charge roller 20.

Then, the uniformly charged surface of the photosensitive drum 19 is exposed using a laser scanner unit 21, and an electrostatic latent image, according to an image information, is formed on the photosensitive drum 19. A laser beam L, which scans the photosensitive drum 19, is light deflected by a polygon mirror provided in the laser scanner unit 21.

The electrostatic latent image is developed and visualized by a developing device 22. A jumping developing method, a two-component developing method or the FEED developing method is employed as the developing method, and frequently, image exposure and inverted developing are employed together.

Using a transferring device, a transferring roller 23, the visual toner image on the photosensitive drum 19 is transferred to a recording medium P that has been conveyed, at a predetermined timing, from a paper supply mechanism (not shown). At this time, a sensor 24 detects the leading edge of the recording medium P and adjusts the timing at which it is being conveyed, so that the toner image on the photosensitive drum 19 can be transferred to a desired location on the recording medium P. At this time, the photosensitive drum 19 and the transferring roller 23 sandwich the recording medium P, which is being conveyed at the predetermined timing, and convey it forward while forcefully applying a constant pressure.

The recording medium P, to which the toner image has been transferred, is further conveyed to a thermal fixing apparatus 25, where the toner image is fixed to the recording medium P as a permanent image.

Following the completion of the transfer process, toner remaining on the surface of the photosensitive drum 19 is removed by a cleaning device 26.

(2) Thermal Fixing Apparatus (Image Heating Apparatus) 25

Figure 2:
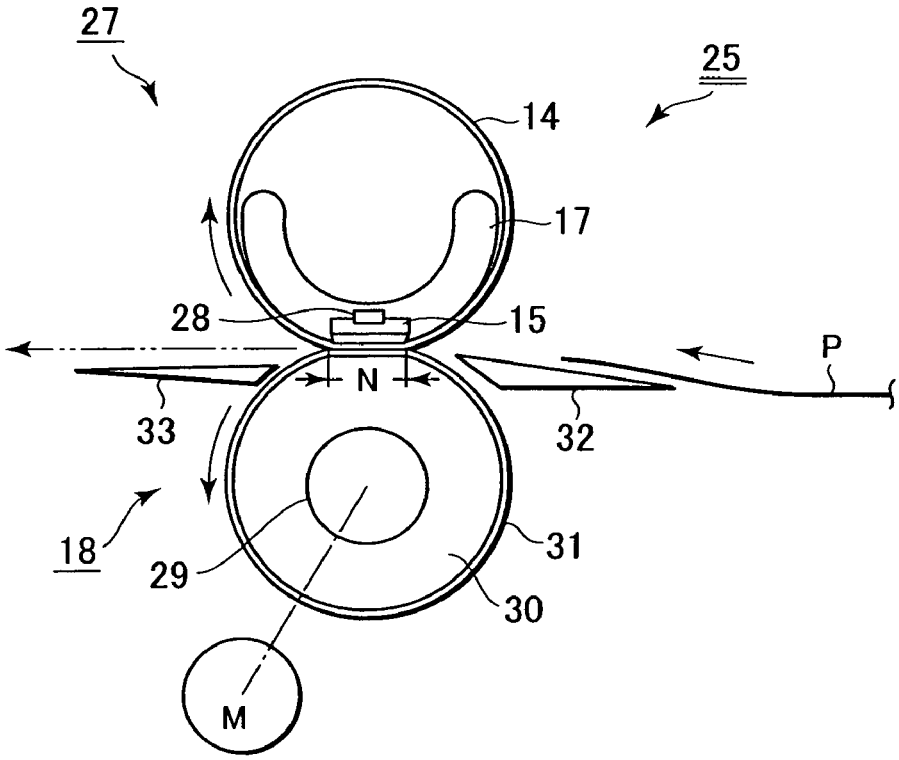
FIG. 2 is a schematic diagram showing the configuration of the image heating apparatus according to the present invention.

FIG. 2 is a schematic diagram showing a specific configuration for the thermal fixing apparatus 25. In this embodiment, the thermal fixing apparatus 25 is a heating apparatus of a film heating type or of a pressurizing rotary member driving type (a tensionless type), as disclosed in Japanese Patent Laid-Open Nos. Hei 4-44075 to 4-44083 or Nos. Hei 4-204980 to 4-204984, for which a flexible fixing film (a flexible sleeve) is employed.

1) General Configuration of the Thermal Fixing Apparatus 25

A fixing nip portion N is formed by pressing together a fixing film assembly 27 and a pressure roller 18, which is a backup roller.

The fixing film assembly 27 includes: a heat resistant, rigid stay holder (a support member) 17 having an eaves gutter shape in a transverse cross section; a ceramic heater 15, fitted into a recessed groove formed in the lower face of the stay holder 17 in the longitudinal direction (the direction perpendicular to the drawing); and a flexible metallic sleeve 14, loosely fitted over the stay holder 17 wherein the ceramic heater 15 is mounted.

The pressure roller 18 is a rotary member that includes a core 29 and a elastic layer 30, concentrically formed on the core 29 of a heat resistant rubber, such as silicon rubber or fluorine rubber, or a foamed silicon rubber. A heat resistant releasing layer 31, made of a fluorine resin such as PFA, PTFE or FEP, may then be deposited on the elastic layer 30.

More specifically, the pressure roller 18 is obtained by forming, around the core 29, a silicon rubber layer 30 or a sponge layer 30 made of foamed silicon rubber, and by overlaying a releasing layer 31, having a tubular shape, of PTFE, PFA or FEP, or by applying a coating of such a releasing layer.

Both ends of the core 29 of the pressure roller 18 are rotatably held, via a bearing member, between side plates on the front and the rear of an apparatus chassis (not shown).

The fixing film assembly 27 is arranged above and parallel to the pressure roller 18, with the ceramic heater 15 side facing downward. Further, both ends of the stay holder 17 are urged toward the pressure roller 18 by pressurizing means (not shown), such as a spring. By utilizing the force exerted by this spring, the fixing nip portion N is formed between the ceramic heater 15 and the pressure roller 18 via the flexible metallic sleeve 14. As another apparatus configuration, the pressure roller 18 may be pushed downward, toward the lower face of the ceramic heater 15, by pressure means, and a fixing nip portion N having a predetermined width may be formed.

The pressure roller 18 is rotated by drive means M at a predetermined peripheral speed in a counterclockwise direction, as indicated by an arrow. As the pressure roller 18 is rotated, friction also rotates the flexible metallic sleeve 14.

A recording medium P bearing a toner image is guided along a heat resistant fixing entrance guide 32 to the flexible metallic sleeve 14 and the pressure roller 18 at the fixing nip portion N. At the fixing nip portion N, the toner image bearing face of the recording medium P is closely attached to the outer face of the flexible metallic sleeve 14, and is conveyed, together with the flexible metallic sleeve 14, through the fixing nip portion N. During the sandwiching and conveying processes, heat generated by the ceramic heater 15 is applied to the recording medium P through the flexible metallic sleeve 14, and the unfixed toner image on the recording medium P is thermally pressurized and is melted and fixed to the recording medium P.

Further, during a period wherein the recording medium P is being conveyed at the fixing nip portion N, since a bias having the same polarity as toner is applied by a power supply brush (not shown) that contacts the flexible metallic sleeve 14, the offset of toner and the scattering of toner can be prevented. The recording medium P, after passing through the fixing nip portion N, is guided by a heat resistant fixed discharge guide 33 and is discharged to a discharge tray (not shown).

2) Stay Holder 17

The stay holder 17 is made of heat resistant plastic, and is used to hold the ceramic heater 15 and also to guide the flexible metallic sleeve 14. In order for the flexible metallic sleeve 14 to slide more smoothly, heat resistant grease is applied between the flexible metallic sleeve 14 and the ceramic heater 15 and the outer face of the stay holder 17.

The stay holder 17 also has a heat insulating function to prevent the discharge of heat in a direction opposite to that of the fixing nip portion N.

3) Flexible Metallic Sleeve 14

In order to improve the quick start performance, the flexible metallic sleeve 14 has a thickness equal to or smaller than 100 μm, preferably, equal to or smaller than 60 μm, and the heat capacity is reduced. In addition, in order to prevent an offset and to appropriately separate a recording medium, a preferable releasing heat resistant resin, a fluorine resin such as PTFE (polytetrafluoroethylene), PFA (tetrafluoroethylene-perfluoroalkylvinyl ether copolymer), EFP (tetrafluoroethylene-hexafluoropropylene copolymer), ETFE (ethylene-tetrafluoroethylene copolymer), CTFE (polychlorotrifluoroethylene) or PVDF (polyvinylidenefluoride), or a silicon resin, is independently coated on or is applied as a mixture of resins to the surface of the flexible metallic sleeve 14.

In this embodiment, the flexible metallic sleeve 14 is very thin, i.e., 20 to 70 μm, so that heat generated by the ceramic heater 15 can be efficiently transmitted to the recording medium at the fixing nip portion N. The flexible metallic sleeve 14 includes three layers: a base layer, a conductive primer layer and a releasing layer. The base layer is the one nearest the heater, while the releasing layer is the one nearest the pressure roller.

The base layer is made of a pure, highly thermal conductive metal, such as SUS, Al, Ni, Cu or Zn, or a highly thermal conductive alloy, is heat resistant, very flexible, and has a thickness of about 15 to 60 μm. With the base layer, the mechanical strength, such as the tear strength of the entire flexible metallic sleeve 14, is maintained.

The conductive primer layer is a thin layer about 2 to 6 μm thick, and is partially exposed at the surface of the flexible metallic layer 14. In order to prevent the electrostatic offset of toner, a conductive brush contacts the portion of the conductive primer layer exposed at the surface of the flexible metallic sleeve 14, and during printing, a bias (a fixing bias), supplied by a power source, that has the same polarity as the toner is applied to this portion. In this embodiment, since the polarity of the charged toner is negative, a negative bias is applied. Instead of applying the bias to the flexible metallic sleeve 14, a charged bias having a polarity opposite that of the toner may be applied to the pressure roller 18, or a bias for each of the two polarities may be applied both to the flexible metallic sleeve 14 and the pressure roller 18.

The releasing layer is a toner offset prevention layer provided relative to the flexible metallic sleeve 14, and is obtained by applying a coating of a preferable releasing, fluorine resin, such as PFA, PTFE or FEP, about 5 to 15 μm thick. Furthermore, in order to reduce an increase in a charge on the surface of the flexible metallic sleeve 14 and to prevent electrostatic offset, a conductive material, such as carbon black, having a specific resistance of about $10^3$ Ωcm to 106 Ωcm is mixed in the releasing layer.

4) Ceramic Heater 15

Figure 3A:
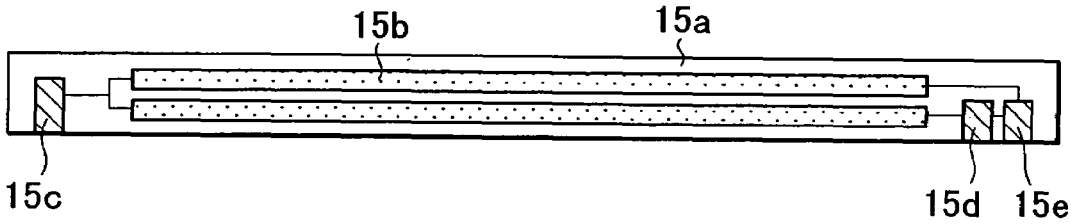
FIGS. 3A and 3B are a plan view and a cross-sectional view of a ceramic heater according to a first embodiment of the invention.
Figure 3B:
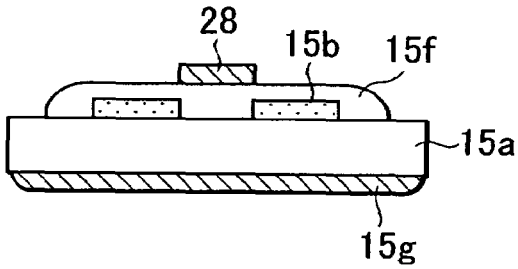

FIGS. 3A and 3B are diagrams showing model arrangements for the ceramic heater 15, as a heating body, according to the embodiment. FIG. 3A is a rear model view, and FIG. 3B is an enlarged transverse cross-sectional model view.

The ceramic heater 15 includes:

1. a heater substrate 15*a* that is a heat resistant, highly insulating and highly thermal conductive member having a small heat capacity, and that is made, for example, of aluminum nitride and is extended in a longitudinal direction perpendicular to the direction in which paper passes through;
2. a heat generation layer (heat generating resistance layer) 15*b*, having a thickness of about 10 μm and a width of about 1 to 5 mm that is made using an electrical resistant material, such as silver palladium (Ag/Pd), RuO2 or Ta2N, that is applied, using screen printing, as lines or as a belt in the longitudinal direction on the rear face of the heater substrate 15*a*, and that generates heat by supplying a current through the heat generation layer 15*b;*
3. electrodes 15*c*, 15*d* and 15*e* that are formed, by screen printing using a sliver paste, as a power supply pattern relative to the heat generation layer 15*b* on the rear face of the heater substrate 15*a;*
4. a thin glass coat 15*f* of about 50 μm that is formed on the heat generation layer 15*b* in order to securely isolate the heat generation layer 15*b* from a thermistor 28 and a thermo switch that are arranged so they contact the ceramic heater 15; and
5. a resin coated layer 15*g*, such as a polyimide layer, that serves as a slide layer that can tolerate sliding against the flexible metallic sleeve 14 provided on the obverse surface of the heater substrate 15*a*.

The ceramic heater 15 is securely supported by the stay holder 17, with the obverse surface exposed downward.

Power supply connectors are attached to the electrodes 15*c*, 15*d* and 15*e* of the ceramic heater 15.

When power is supplied to the electrodes 15*c*, 15*d* and 15*e* by a heater drive circuit (not shown) via the power supply connectors, the heat generation layer 15*b* generates heat and the temperature of the ceramic heater 15 is rapidly raised (AC line).

The temperature of the ceramic heater 15 is detected by the thermistor 28, and electric information for the detected temperature is transmitted to the heater drive circuit (DC line).

The heater drive circuit appropriately controls power supplied to the heat generation layer 15*b* so that the temperature detected by the thermistor 28 is maintained at a set temperature (a fixing temperature). Using this control process, the fixing enabled temperature is maintained at the fixing nip portion N. That is, substantially, a constant temperature is maintained at the fixing nip portion N, and the heat required for fixing a toner image to a recording medium is produced.

The details of the slide layer 15*g* of the ceramic heater 15 will now be described.

The slide layer 15*g* is coated by dipping, spraying or screen printing, and is baked. The slide layer 15*g* in this embodiment is a polyimide-base slide layer that contains silicon nitride (an abrasion resistant material). As will be described later, a paste in which a predetermined amount of an abrasion resistant material is mixed with polyimide is applied using screen printing; during the manufacturing process, it is preferable that a coat of this paste be applied in accordance with the following conditions.

As one condition, a pre-process is performed for the substrate before it is coated, i.e., the surface of the substrate is polished using sandpaper or is coated by applying a coupling agent, such as a silane coupling agent, to provide an improved close attachment between the substrate and the coating agent. The purpose of the pre-process is to remove fat and oil and dust from the surface by polishing, or to improve the adhesiveness by the coupling process. Through this preprocess, the same effects can be obtained not only for the polyimide slide layer 15*g*, but also for another coated material. The coated polyimide layer should be dried satisfactorily for thirty minutes or longer at about 100 to 200° C., and be baked at a high temperature equal to or higher than 350° C. and equal to or lower than 450° C. This is because a solvent component is to be gradually evaporated using an appropriate drying process, and an imide reaction is to be completely progressed by baking. As a result, a slide layer 15 can be obtained that has superior abrasion resistance. The baking temperature, the drying temperature and the periods required for these processes will differ, depending on the type and the maker of the polyimide that is employed and the output and the size of the oven. Note that the temperature range is not limited to that described above.

The slide layer is formed using the above described method. In order to examine the characteristics of the slide layer to increase its durability, several examples were compared and studied from the viewpoints of the content (mass %), the particle size, the shape, the specific gravity and the hardness.

1. Content

Silicon nitride ($Si_3N_4$) was employed as an abrasive material, and heaters were prepared wherein four types of polyimide pastes, which respectively contained 1 mass %, 5 mass % and 10 mass % of silicon nitride and no silicon nitride were deposited using screen printing. The polyimide films at this time had the same thickness, 5 μm, and the mean particle size of $Si_3N_4$ was 0.7 μm.

Before the four heaters were attached to thermal fixing apparatuses, the surface roughness of each sliding layer 15*g* was measured. Thereafter, the heaters were mounted on the thermal fixing apparatuses, and drive torques and fixing characteristics were measured. Then, 200,000 recording sheets were printed, and the drive torques and the thicknesses of the slide layers 15*g* were measured. The drive torque is the torque required by the pressure roller 18 to rotate the flexible metallic sleeve 14.

The obtained results are shown in Table 1 below.

TABLE 1

| | Content (Mass %) | | | |
|---|---|---|---|---|
| | Ref (0%) | $Si_3N_4$ 1% | $Si_3N_4$ 5% | $Si_3N_4$ 10% |
| Surface Roughness Rz (μm) | 1.8 | 2.2 | 4.5 | 6.7 |
| Initial Drive Torque (kg · cm) | 4.2 | 4.4 | 4.8 | 5.8 |
| Film Thickness (μm) | 3.2 | 4.5 | 4.3 | 3.7 |
| Drive Torque After Abrasion (kg · cm) | 5.0 | 4.5 | 4.9 | 6.5 |

Figure 4A:
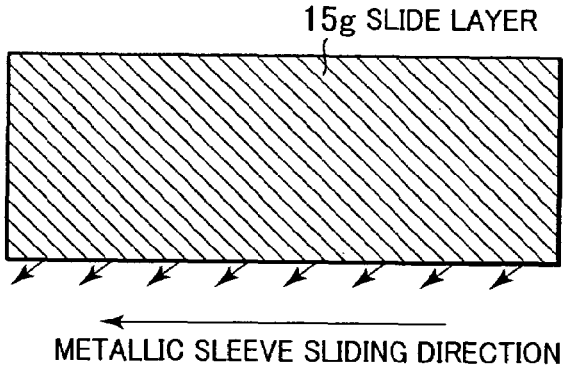
FIGS. 4A and 4B are diagrams for explaining an abrasion mechanism for the slide layer of the ceramic heater.

As shown in Table 1, for a slide layer 15*g* that did not contain silicon nitride as an abrasion resistant material, the surface roughness, the drive torque and the fixing characteristic were appropriate at the initial stage. However, the film thickness after abrasion was greatly reduced. This is because, as shown in FIG. 4A, since the inner peripheral face of the flexible metallic sleeve 14 was rotated while rubbing the surface of the slide layer 15*g*, a force indicated by arrows was exerted on the surface of the slide layer 15*g*, and polyimide coated on the surface of the slide layer 15*g* was gradually dissociated by abrasion. Further, the drive torque after abrasion was also increased. This was probably because fragments of polyimide dissociated by abrasion, and grease, a lubricant, were mixed together, and the smoothness of the grease was lost.

Figure 4B:
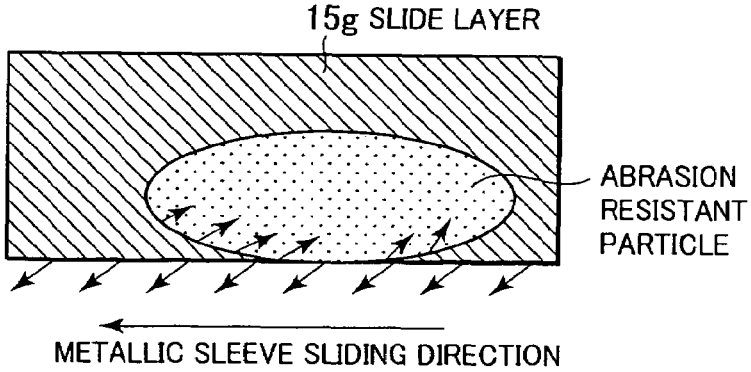

For the slide layers 15*g* that contained 1% and 5% of silicon nitride, the reduction in the film thickness after abrasion was smaller than was that of a slide layer 15*g* that did not contain silicon nitride. This was probably because of the following reason. As shown in FIG. 4B, polyimide was gradually dissociated from the topmost surface of the slide layer 15*g* by a friction force exerted against the flexible metallic sleeve 14, however, when silicon nitride particles were contained as an abrasion resistant material in the slide layer 15*g*, an adhesive force between silicon nitride and polyimide was strong enough to exert an anchoring effect at the interface of the silicon nitride particles and the polyimide, and dissociation of polyimide near silicon nitride particles was suppressed.

However, when the content of the silicon nitride was 10 mass %, the surface roughness of the slide layer 15*g* was increased because of the silicon nitride particles in the vicinity of the surface of the slide layer 15*g*. Accordingly, the frictional force between the inner peripheral face of the flexible metallic sleeve 14 and the slide layer 15*g* was magnified, and the drive torque was increased. Further, compared with the slide layers 15*g* that contained 1 mass % and 5 mass % of silicon nitride and that had small drive torques, a slide layer 15*g* that contained 10 mass % of silicon nitride exerted a larger frictional force against the flexible metallic sleeve 14. Therefore, although a large amount of the abrasion resistant material was contained, the abrasion of polyimide and the reduction in the thickness of the slide layer 15*g* was increased by the wearing down of the slide layer 15*g*. Furthermore, it was also considered that large quantities of polyimide and silicon nitride were dissociated from the slide layer 15*g* and was mixed with the grease, a lubricant, and deterioration of the grease was accelerated, so that after abrasion the drive torque was also increased.

Based on the above results, and while taking into account the initial drive torque, the drive torque after abrasion and the durability of the slide layer, it was felt that the appropriate content of the abrasion resistant material should be greater than 0% and less than 10%. In addition, the appropriate surface roughness of the slide layer immediately after polyimide had been coated on the ceramic substrate of a heater (after the baking process had been completed) should be equal to or smaller than 5 μm, according to Rz (ten point height of irregularities).

2. Particle Size

Four heaters were prepared wherein polyimide pastes that contained 1 mass % of silicon nitride as an abrasion resistant material and had mean particle sizes of 0.7 μm, 2.0 μm and 4.0 μm were deposited 5 μm thick using screen printing. These heaters were mounted on thermal fixing apparatuses, and initial drive torques were measured. Further, 200,000 sheets were printed, and the drive torques and the thicknesses of the polyimide layers were measured. The obtained results are shown in the following table.

The initial drive torques were almost unchanged when the mean particle sizes were increased. This is probably because, since the silicon nitride content was 1 mass %, the amount of abrasion resistant material was reduced when the mean particle size was large, and the force exerted by friction between the polyimide slide layer and the fixing film would not be increased. However, reference the durability of the polyimide layer that contained 1 mass % of silicon nitride having a mean particle size of 0.7 μm, there was almost no increase in the drive torque after abrasion, when compared with the drive torque before abrasion, and there was only a small reduction in the film thickness after abrasion. For the polyimide layer that contained 1 mass % of silicon nitride having a mean particle size of 2.0 μm, the drive torque after abrasion was slightly increased, and the reduction in the film thickness after abrasion was greater than the mean particle size of 0.7 μm. Further, for the polyimide layer that contained 1 mass % of silicon nitride having a mean particle size of 4.0 μm, the drive torque after abrasion was much increased, compared with the polyimide layer that did not contain silicon nitride. That is, it was found that, as the mean particle size of the abrasion resistant material became smaller, the drive torque after abrasion was smaller, there was a small reduction in the thickness of the polyimide layer and the durability was superior.

TABLE 2

| | Mean Particle Size | | | |
|---|---|---|---|---|
| | 0.7 μm | 2.0 μm | 4.0 μm | None |
| Initial Drive Torque (kg · cm) | 4.4 | 4.5 | 4.4 | 4.2 |
| Drive Torque After Abrasion (kg · cm) | 4.5 | 4.8 | 5.8 | 4.8 |
| Film Thickness After Abrasion (μm) | 4.5 | 4.2 | 3.8 | 3.5 |

Figure 5A:
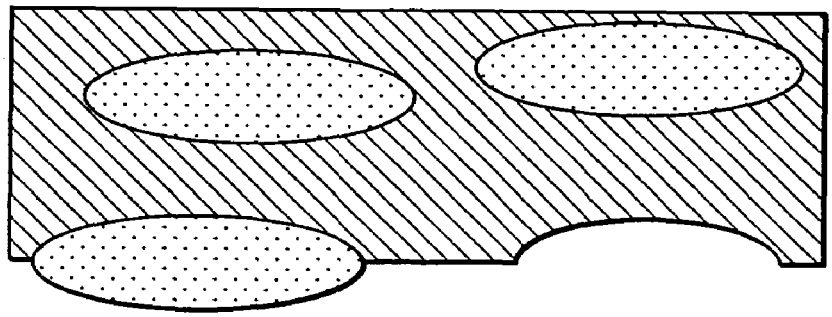
FIGS. 5A, 5B and 5C are diagrams for explaining abrasion differences due to differences in the mean particle sizes of abrasion resistant materials.
Figure 5B:
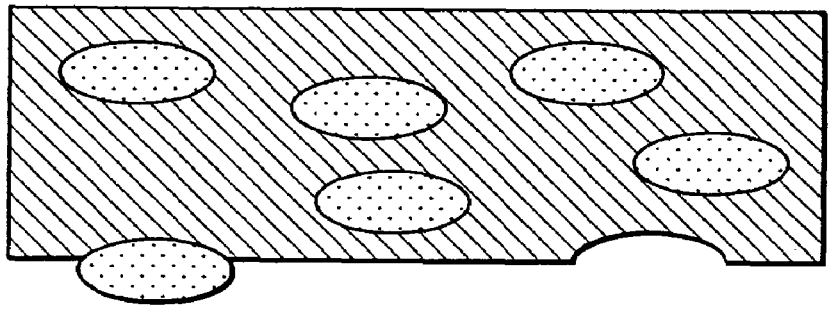
Figure 5C:
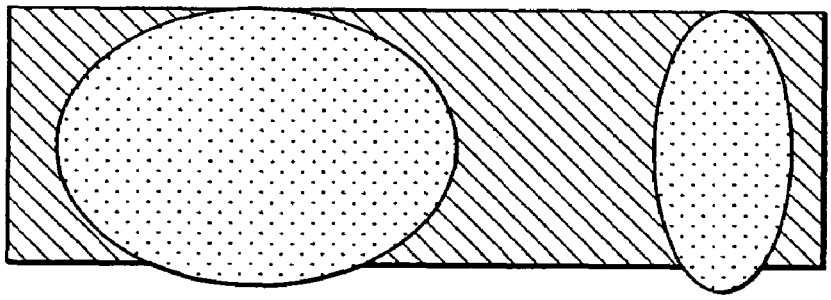

This is true for the following reasons. As abrasion progresses, polyimide is worn out and the abrasion resistant material is exposed. When the mean particle size of the abrasion resistant material is large, as shown in FIG. 5A, there is a great difference between the portion whereat the abrasion resistant portion is exposed and the portion whereat the material is not exposed, and the overall surface roughness is increased. As a result, the force exerted by friction is increased, and accordingly, there is an accelerated rise in the drive torque and in abrasion. Furthermore, when the abrasion resistant material is dissociated from the polyimide slide face, abrasion is accelerated at the recessed portion from which this material was dissociated, and in this case, when the particle size of the abrasion resistant material is large, a large recessed portion is formed as shown in FIG. 5A, and abrasion is increased at the position whereat the abrasion resistant material is dissociated. When the particle size of the abrasion resistant material is comparatively small, as shown in FIG. 5B, abrasion is reduced at the position whereat the abrasion resistant material is dissociated. In addition, it is felt that an abrasion resistant material having a large particle size will damage the slide layer after it is dissociated from the slide layer. Furthermore, an abrasion resistant material whose mean particle size is greater than the initial thickness of the slide layer is not appropriate as a slide layer because, as shown in FIG. 5C, the abrasion resistant layer will be exposed and the force exerted by friction will be high.

Based on the above described results, it is preferable that the mean particle size of the abrasion resistant material be equal to or smaller than 2.0 μm and equal to or smaller than the thickness of the slide layer. Further, in order to increase the durability of the slide layer by using the abrasion resistant material, a mean particle size equal to or greater than 0.1 μm of the abrasion resistant material is required. Thus, it is preferable that the mean particle size of the abrasion resistant material be equal to or greater than 0.1 μm and equal to or smaller than 2.0 μm.

3. Shape

Heaters were prepared wherein a polyimide paste that contained 1 mass % of silicon nitride as an abrasion resistant material and had a mean particle size of about 0.7 μm was deposited 5 m thick by screen printing. In this case, two types of shapes were employed for the abrasion resistant material: a spherical shape and a scale shape. These heaters were mounted in thermal fixing apparatuses, and drive torques in the initial state were measured. Further, 200,000 sheets were printed to wear down the polyimide layers, and the drive torques and the thicknesses of the polyimide layers were measured. The obtained results are shown in Table 3 below.

TABLE 3

| | Shape | |
|---|---|---|
| | Scale | Sphere |
| Initial Drive Torque (kg · cm) | 4.4 | 4.3 |
| Film Thickness After Abrasion (μm) | 4.5 | 4.1 |
| Drive Torque After Abrasion (kg · cm) | 4.5 | 5.1 |

There was almost no difference between the initial drive torques, even though the shapes of the abrasion resistant materials differed. However, when the results obtained after abrasion were compared, the reduction in the film thickness in the case of the scale shape was 0.5 μm, while the reduction in the film thickness in the case of the spherical shape was greater, i.e., 0.9 μm. Further, the drive torque in the case of the scale shape was almost not raised from what it was originally, while in the case of the spherical shape, the drive torque was greatly increased. This was a likely result because, since the ratio of the surface area of the sphere to the volume was smaller than the ratio of the surface area of the scale to the volume, the dimensions of the area of the sphere that contacted polyimide was small, so that only a small anchor effect was obtained to prevent dissociation of polyimide from the slide layer.

Based on the above results, it is preferable that the shape of the abrasion resistant material be one for which the ratio of the surface area to the volume is large, e.g., a scale shape.

4. Density

Two heaters were prepared wherein polyimide pastes that respectively contained abrasion resistant materials having different densities were deposited 5 μm thick by screen printing. Silicon nitride (3.2 g/cm$^3$) and boron nitride (2.3 g/cm$^3$) were employed as the abrasion resistant materials. At this time, the density of polyimide was 1.1 g/cm$^3$, the mean particle size of the abrasion resistant materials was 0.7 μm and they had a content of 1.0 mass %. For these two heaters, the surface roughnesses of the initial slide layers and the initial drive torques were compared. The obtained results are shown in the table below.

TABLE 4

| | Abrasion Resistant Material | |
|---|---|---|
| | Silicon Nitride | Boron Nitride |
| Density (g/cm$^3$) | 3.2 | 2.3 |
| Surface Roughness Rz (μm) | 2.2 | 2.8 |
| Initial Drive Torque (kg · cm) | 4.4 | 4.9 |

Figure 6A:
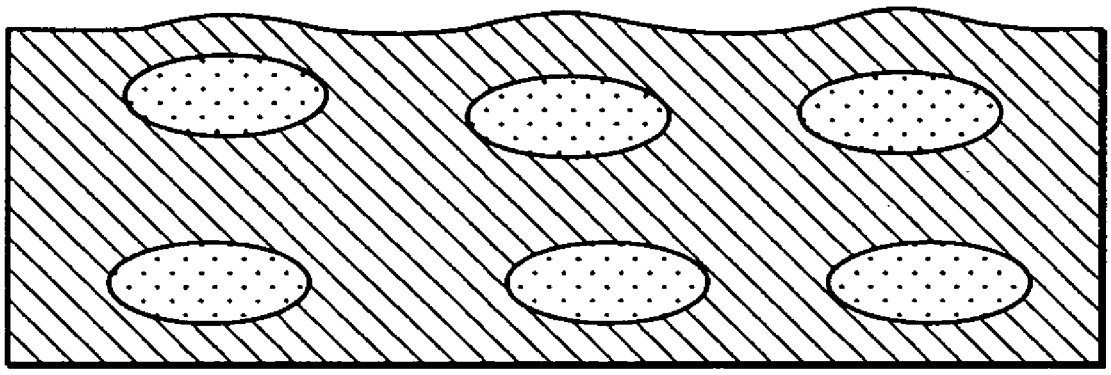
FIGS. 6A and 6B are diagrams for explaining differences in surface roughness due to differences in the densities (specific gravities) of abrasion resistant materials.
Figure 6B:
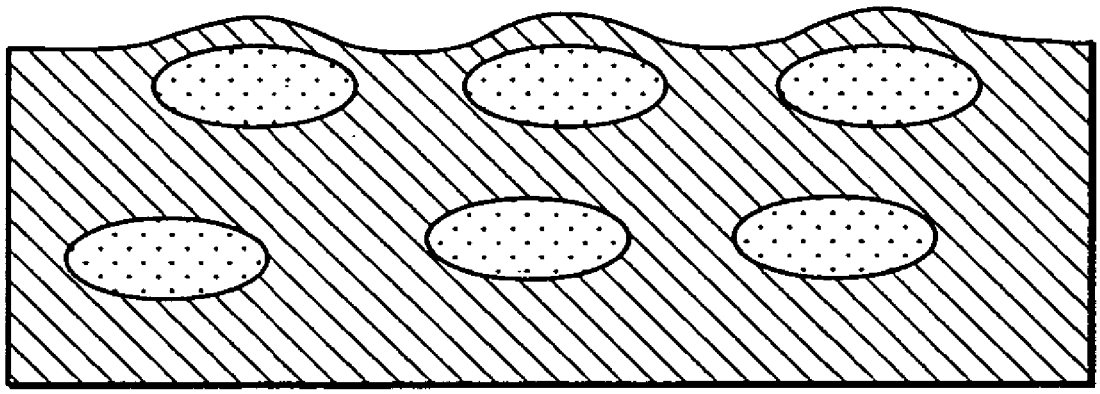

The surface roughness was increased when boron nitride having a low density was employed as an abrasion resistant material. This was possibly related to the density (specific gravity) of the abrasion resistant material, and it is considered that, in the process during which the polyimide paste was coated on the heater face and baked, silicon nitride having a higher density (specific gravity) tended to sink to the bottom (near the ceramic substrate) of the polyimide layer. As a result, when silicon nitride is employed as the abrasion resistant material, it is considered that, as shown in FIG. 6A, since the quantity of the abrasion resistant material near the surface of the slide layer is comparatively small, the surface roughness of the slide layer will not be greatly affected. When boron nitride is employed as the abrasion resistant material, it is considered that, as shown in FIG. 6B, since the abrasion resistant material sinks to the bottom of the polyimide paste less easily than when silicon nitride is employed, more abrasion resistant material is present near the surface of the slide layer, and this adversely affects the surface roughness of the slide layer. Furthermore, since the surface roughness becomes greater and the friction relative to the flexible metallic sleeve 14 is accordingly increased, there is a slight increase in the drive torque for a thermal fixing apparatus that employs boron nitride as the abrasion resistant material.

During the initial use period, since the lubricating grease coated on the surface of the slide layer has not yet been evenly and smoothly extended across the inner peripheral face of the flexible metallic sleeve 14, rotation of the flexible metallic sleeve 14 tends to be difficult. Therefore, for the rotation of the flexible metallic sleeve 14, the initial surface roughness of the slide layer is very important. That is, when the initial surface of the slide layer is rough due to the presence of abrasion resistant material, the drive torque will be increased, and together with the factor that lubricating grease has not yet been smoothly extended, the flexible metallic sleeve 14 may not be stably rotated.

In accordance with the above described results, an abrasion resistant having a high density (specific gravity) is preferable, and at the least, a material having a density (specific gravity) greater than that of the base resin of the slide layer is preferable. More preferably, the abrasion resistant material must have equal to or greater than twice the density (specific gravity) of the base material of the slide layer, and even more preferably, must have equal to or greater than three times the density (specific gravity).

5. Hardness

When the hardness of the abrasion resistant material is lower than the hardness of the flexible metallic sleeve 14, the abrasion resistant material is easily scraped by rubbing against the flexible metallic sleeve 14, and does not function as an abrasion resistance material. Therefore, in order to withstand being rubbed against the flexible metallic sleeve 14, an abrasion resistant material should be employed that has a greater hardness than the flexible metallic sleeve 14.

Second Embodiment

A second embodiment of the present invention will now be described. Since the overall configuration of the image forming apparatus and the overall configuration of the thermal fixing apparatus for this embodiment are the same as those for the first embodiment explained while referring to FIGS. 1 and 2, no further explanation for them will be given.

Figure 7:
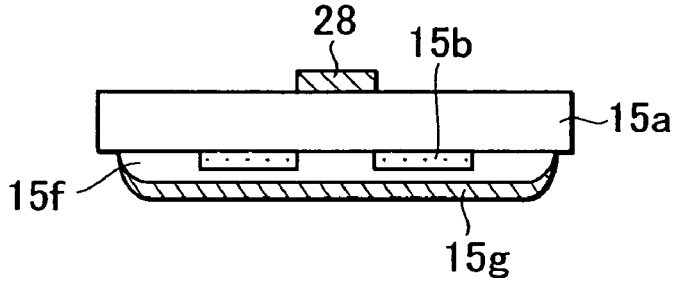
FIG. 7 is a cross-sectional view of a ceramic heater according to a second embodiment of the present invention.

FIG. 7 is a detailed diagram showing the are of a heater according to the second embodiment. In this embodiment, a heater 15 is a narrow, plate-shaped ceramic heater of an obverse face heating type. Specifically a heat generating resistance layer 15*b* of the heater 15 is located on a heater substrate 15*a* near a fixing nip N, and a protective glass coat layer 15*f* is formed to protect the heat generating resistance layer 15*b*. Further, a slide layer 15*g* is overlaid to improve sliding relative to a flexible metallic sleeve 14.

Since a heat generation body 15*b* and the flexible metallic sleeve 14 should be completely insulated from each other when the slide layer 15*g* is worn down, a thickness of equal to or greater than 30 μm is required for the protective glass coat layer 15*f*. When the protective glass coat layer 15*f* is too thick, however, heat conduction to the flexible metallic sleeve 14 would be lost; thus, a thickness equal to or smaller than 100 μm is appropriate. Therefore, it is appropriate that the protective glass coat layer 15*f* be deposited so it is equal to or greater than 30 μm thick and equal to or less than 100 μm thick. As in the first embodiment, the slide layer 15*g* is coated with a resin, such as polyimide or polyamideimide, that contains an abrasion resistant material.

For the heater of a rear face heating type in the first embodiment, the heat generating resistance layer 15*b* is located on the heater substrate 15*a* on the opposite nip side; however, when alumina is employed for the heater substrate 15*a* of the heater 15, the heat generating resistance layer 15*b* should be located on the heater substrate 15*b* on the nip face side so that heat can be transmitted through the protective glass coat layer 15*f* toward the nip portion. In this manner, superior thermal efficiency can be obtained. Specifically, as for comparative thermal conductivity, alumina is superior to glass, and generally, an alumina substrate has a thickness of 0.5 to 1.0 mm, in order to provide strength for the heater 15, while when a glass coat layer is deposited, it is 20 to 60 μm thick. Therefore, when heat resistances are compared while taking heat capacities into account, the arrangement, as in the heater of the obverse surface heating type for this embodiment, wherein the heat generating resistance layer 15*b* is located on the heater substrate 15*a* facing the nip portion provides superior heat conduction. When the heater substrate 15*a* is made of a material other than alumina, there may be a case, as in this embodiment, wherein it is better to locate the heat generating resistor on the face of the substrate opposite the nip portion, depending on the thickness of the heater substrate 15*a* and the thickness of the glass coat layer 15*f*.

For the heater of the rear face heating type in the first embodiment, the periphery of the thermistor should be sealed, for example, using a heat resistant insulating protective tape in order to provide satisfactory insulation between the thermistor 28 and the heat generating resistance layer 15*b*. Because of this tape, the temperature detection response of the ceramic heater 15 can be lost and the possibility of an electric power overshoot increased. On the other hand, with a heater of an obverse face heating type as in this embodiment, since the heat generating resistance layer 15*b* is located on the obverse surface, the heater substrate 15*a* serves as an insulating layer, and the thermistor 28 can directly contact, or be bonded to, the reverse surface of the heater substrate 15*a*. Therefore, the temperature detection response is excellent, and the temperature of the heater 15 can be easily controlled.

Figure 8:
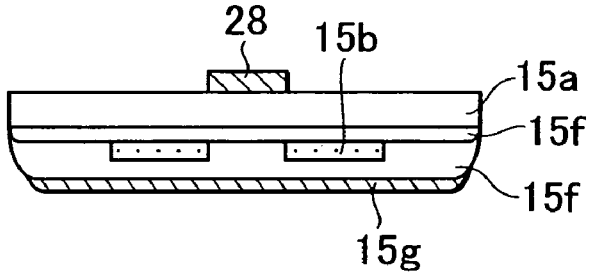
FIG. 8 is a cross-sectional view of a ceramic heater according to a modification of the second embodiment.
Figure 9:
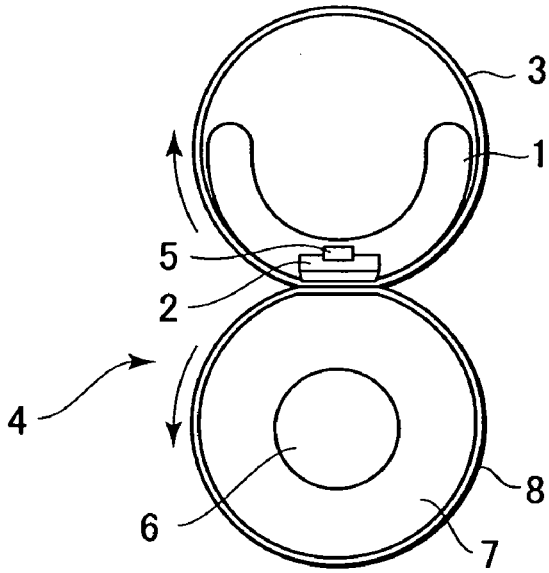
FIG. 9 is a schematic diagram showing the configuration of a conventional thermal fixing apparatus.

Further, according to the configuration of this embodiment, wherein the slide layer 15*g* is deposited on the glass coat layer 15*f*, as shown in FIG. 8, instead of a ceramic substrate, a metal substrate made, for example, of SUS may be employed as the heater substrate 15*a* of the heater 15, an insulating protective coat layer 15*f* may be deposited across the entire metal substrate 15*a*, and a heat generating layer 15*b*, a second protective glass coat layer 15*f* and a slide layer 15*g* may be formed in the named order. When such an excellent heat conductive metal substrate is employed as a heater substrate, a more uniform temperature can be maintained in the longitudinal direction than when a ceramic substrate is used, and an image can be obtained that is less unevenly fixed or has a less uneven gloss. Furthermore, the substrate can be protected from destruction by the thermal stress that is caused by rapid temperature rises in a heater.

As is described above, according to this embodiment, when the heat generating resistance layer is arranged on the obverse surface of the heater substrate, the glass coat layer and the slide layer are deposited on the heater substrate in the named order, so that sliding relative to the flexible metallic sleeve can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Laid-Open No. 2004-269959, filed Sep. 16, 2004, which is hereby incorporated by reference herein in its entirety.

What is claimed is:

1. An image heating apparatus for heating an image formed on a recording material, comprising:

a flexible metallic sleeve; and a heater, which contacts an inner peripheral surface of the flexible metallic sleeve, wherein an imide resin layer is formed on a surface of the heater that contacts the inner peripheral surface of the flexible metallic sleeve, wherein the imide resin layer has a thickness equal to or greater than 2 μm and equal to or smaller than 10 μm, and contains an abrasion resistant material, wherein particles of the abrasion resistant material have a mean size equal to or greater than 0.1 μm and equal to or smaller than 2.0 μm, and the abrasion resistant material content is greater than 0% and less than 10%, and wherein the abrasion resistant material has a specific gravity at least twice that of the imide resin layer in a state of a paste of an imide resin mixed with a solvent component.

2. An image heating apparatus according to claim 1, wherein the abrasion resistant material has a scale shape.

3. An image heating apparatus according to claim 1, wherein the abrasion resistant material is silicon nitride.

4. An image heating apparatus according to claim 3, wherein the imide resin is polyimide.

5. An image heating apparatus according to claim 1, further comprising:

a back-up roller for forming a nip portion together with the heater while the flexible metallic sleeve is interposed therebetween, wherein the nip portion is effective to nip and feed the recording material, and the image formed on the recording material is heated by heat supplied from the flexible metallic sleeve.

6. A heater comprising:

a substrate;

a heat generating resistor formed on the substrate; and an imide resin layer that contacts a flexible metallic sleeve, wherein the imide resin layer has a thickness equal to or greater than 2 μm and equal to or smaller than 10 μm, and contains an abrasion resistant material, wherein particles of the abrasion resistant material have a mean size equal to or greater than 0.1 μm and equal to or smaller than 2.0 μm, and the abrasion resistant material content is greater than 0% and less than 10%, and wherein the abrasion resistant material has a specific gravity at least twice that of the imide resin layer in a state of a paste of an imide resin mixed with a solvent component.

7. A heater according to claim 6, wherein the abrasion resistant material has a scale shape.

8. A heater according to claim 6, wherein the abrasion resistant material is silicon nitride.

9. A heater according to claim 8, wherein the the imide resin is polyimide.

10. An image heating apparatus for heating an image formed on a recording material, comprising:

a flexible metallic sleeve; and a heater that contacts an inner peripheral surface of the flexible metallic sleeve, wherein a resin layer is formed on a surface of the heater that contacts the inner peripheral surface of the flexible metallic sleeve, wherein a material for the resin layer is an imide resin containing silicon nitride particles, and wherein a specific gravity of the resin layer in a state of a paste of an imide resin mixed with a solvent component is equal to or less than half of that of the silicon nitride particles.

11. An image heating apparatus according to claim 10, wherein the imide resin is polyimide.

12. An image heating apparatus according to claim 10, further comprising:

a back-up roller for forming a nip portion together with the heater while the flexible metallic sleeve is interposed therebetween, wherein the nip portion is effective to nip and feed the recording material, and the image formed on the recording material is heated by heat supplied from the flexible metallic sleeve.

13. A heater comprising:

a substrate;

a heat generating resistor formed on the substrate; and a resin layer that contacts a flexible metallic sleeve, wherein a material for the resin layer is an imide resin containing silicon nitride particles, and wherein a specific gravity of the resin layer in a state of a paste of an imide resin mixed with a solvent component is equal to or less than half of that of the silicon nitride particles.

14. A heater according to claim 13, wherein the imide resin is polyimide.

* * * * *